US006942007B2

(12) United States Patent
Meyer

(10) Patent No.: US 6,942,007 B2
(45) Date of Patent: Sep. 13, 2005

(54) EQUIPMENT FOR MOLDING FOUNDRY PARTS WITH IMPROVED MEANS POSITIONING SAND CORES, AND RELATED POSITIONING METHOD

(75) Inventor: Philippe Meyer, Ronquerolles (FR)

(73) Assignee: Montupet SA (FR)

( * ) Notice: Subject to any disclaimer, the term of this patent is extended or adjusted under 35 U.S.C. 154(b) by 0 days.

(21) Appl. No.: 10/333,479

(22) PCT Filed: Jul. 19, 2001

(86) PCT No.: PCT/FR01/02352

§ 371 (c)(1),
(2), (4) Date: Jun. 18, 2003

(87) PCT Pub. No.: WO02/07914

PCT Pub. Date: Jan. 31, 2002

(65) Prior Publication Data

US 2004/0099398 A1 May 27, 2004

(30) Foreign Application Priority Data

Jul. 21, 2000 (FR) ..... 00 09602

(51) Int. Cl.[7] ..... B22C 9/10
(52) U.S. Cl. ..... 164/137; 164/32; 164/340
(58) Field of Search ..... 164/137, 339, 164/340, 341, 369, 465, 28, 32

(56) References Cited

U.S. PATENT DOCUMENTS 4,858,670 A * 8/1989 Field et al. ..... 164/11
5,261,478 A * 11/1993 Sun ..... 164/137
5,392,841 A * 2/1995 Anderson et al. ..... 164/113
5,704,412 A * 1/1998 Gurdebeke ..... 164/127
5,862,853 A * 1/1999 Eliat ..... 164/340
6,516,869 B2 * 2/2003 Crivellone et al. ..... 164/340

* cited by examiner

*Primary Examiner*—Jonathan Johnson
*Assistant Examiner*—Len Tran
(74) *Attorney, Agent, or Firm*—Blakely, Sokoloff, Taylor & Zafman

(57) ABSTRACT

The invention provides equipment for molding castings in a mold having at least one sand core (Na1), in which the positioning of the or each core is obtained by the core co-operating with an element (S) of the mold, in particular a metal mold element. This equipment is remarkable in that the or each core possesses an insert (I) secured to the core while making said core and via which said core is suitable for co-operating with the mold element in question. The invention also provides an associated method of positioning cores. The invention is particularly applicable to improving the positioning of admission pipes in light alloy cylinder heads for engines.

6 Claims, 2 Drawing Sheets

EQUIPMENT FOR MOLDING FOUNDRY PARTS WITH IMPROVED MEANS POSITIONING SAND CORES, AND RELATED POSITIONING METHOD

This is a non-provisional application claiming the benefit of International application number PCT/FR01/02352 filed Jul. 19, 2001

The present invention relates in general to a system for positioning cores when making aluminum castings in metal molds.

BACKGROUND OF THE INVENTION

When sand cores are used for making castings out of aluminum alloy or any other light alloy, the precision with which sand cores are positioned contributes in determining manner to the dimensional precision of castings made in a metal mold since said positioning is essential in determining the inside shapes of the casting, and also some of its outside shapes.

More precisely, and by way of example, when casting cylinder heads for motor vehicle engines, important engine functions are directly associated with the positioning of the cores: this applies in particular to the admission and exhaust ducts or pipes, which are made entirely by means of cores, and for which positioning precision has a direct influence on the performance of an engine (power, fuel consumption, polluting emissions, etc.).

Unfortunately, interaction between cores and metal mold elements raises problems which go against accurate control over dimensional positioning. Cores are generally made out of a mixture of sand (usually silica) of well-defined grain size and organic chemical binders which provide the core with cohesion and strength.

These binders are conventionally hardened in two broad families of core-making methods, either by using the "cold box" technique (i.e. using a gaseous chemical catalyst) or else the "hot box" technique (i.e. by delivering heat to the core box which is itself raised in temperature). However, regardless of which of those two core-making techniques is used, the cores behave in similar manner while casting is taking place. Thus, once they are placed in the mold which is itself already at a certain temperature, typically lying in the range 80° C. to 300° C. for its cooler portions and 400° C. to 500° C. for its hotter portions, the binders in the cores begin to decompose and to give off gaseous residues.

That process is then accelerated while liquid aluminum if being cast, since the aluminum penetrates into the mold at temperatures typically lying in the range 600° C. to 750° C.

The gaseous residues condense on the metal portions of the mold, locally building up successive layers of scale constituted by solid residues of said decomposition that are carbonized to varying extents.

Those residues are extremely hard and prevent cores being properly positioned on the metal portions.

To return to the example of admission or exhaust ducts in a cylinder head, the profile of the chamber is generally made by means of a cooled metal mold element serving to accelerate cooling of the aluminum locally during solidification, thereby locally refining its microstructure and improving its properties (strength, hot and cold fatigue performance, breaking elongation, etc.).

The cores that form the ducts stand on the cooled metal element. Thus, the scale accumulating on the contact surface of the metal mold element offsets the core ducts, thereby disturbing the precision with which they are positioned, and leading to the above-mentioned drawbacks.

In practical manufacture, that problem can be solved only by leaving substantial clearance for the guides and supports situated on the surfaces of the metal elements which interact with the facing surfaces of the cores, and by keeping these surfaces clean by cleaning them at regular intervals during manufacture, for example by brushing them.

Such operations disturb manufacture since they lengthen cycle times and damage the release coating that protects the mold elements from liquid aluminum, thereby requiring said coating to be repaired locally where necessary.

The manufacturer thus seeks to space such cleaning operations as far as apart as possible, but that goes against eliminating accumulations of scale.

Thus, in production, present practice is a compromise between those various constraints, thus putting a limit on the dimensional precision with which cores are positioned on metal elements.

SUMMARY OF THE INVENTION

The present invention seeks to mitigate those limitations of the state of the art.

For this purpose, in a first aspect, the present invention provides equipment for molding castings, in particular cylinder heads for vehicle engines, in a mold having at least one sand core, in which the positioning of the or each core is obtained by the core co-operating with an element of the mold, in particular a metal mold element, the equipment being characterized in that at least one core possesses an insert secured to the core while making said core and via which said core is suitable for co-operating with the mold element in question.

Certain preferred but non-limiting features of the molding equipment of the invention are as follows:

- the or each insert possesses one or more sealing appendices suitable for being held captive in the mass of the core(s) during preparation thereof;
- at least two cores possess a common insert provided with a corresponding number of respective sealing appendices;
- the co-operation between the or each insert and the associated mold element is shape co-operation defining a support in at least one out of three dimensions;
- the shape co-operation between the or each insert and the associated mold element defines support in two out of three dimensions;
- the shape co-operation between the or each insert and the associated mold element defines support in all three dimensions;
- the shape co-operation between the or each insert and the associated mold element defines wedging in at least one direction extending transversely to a main support direction for the insert;
- the equipment includes a set of cores made as a single piece and having a plurality of inserts secured thereto suitable for co-operating with a common mold element, and the various inserts provide support and/or wedging in different ones of three dimensions; and
- the cores are admission pipe cores for a cylinder head of an engine having a plurality of cylinders.

In a second aspect, the present invention provides a method of positioning a core in a mold for making a casting having at least one cavity defined by the positioning of a core, such as an aluminum alloy cylinder head for an engine, the method being characterized in that it comprises the following steps:

- making a metal insert having at least one support surface suitable for co-operating with a mold element, and at least one element for anchoring to the core;

making the core in a core box in which the insert has previously been placed in a predetermined position so that an end region of the core becomes anchored to said insert via the anchoring element(s) thereof; and placing the core with its insert in the mold in a position that is predetermined by co-operation between the support surface(s) of the insert and said mold element.

Preferred but non-limiting features of the method of the invention are as follows:

the predetermined position of the insert in the core box is determined by co-operation between the support surface(s) of said insert and a support portion of the core box;

the step of making the core comprises making at least two cores which are anchored to a common insert;

the insert is made by molding metal under pressure;

the core is an admission pipe core; and the core is made by the cold box method.

BRIEF DESCRIPTION OF THE DRAWINGS

Other aspects, objects, and advantages of the present invention appear more clearly on reading the following detailed description of a preferred embodiment thereof, given by way of non-limiting example and with reference to the accompanying drawings, in which.

DETAILED DESCRIPTION OF AN EMBODIMENT

Figure 1:
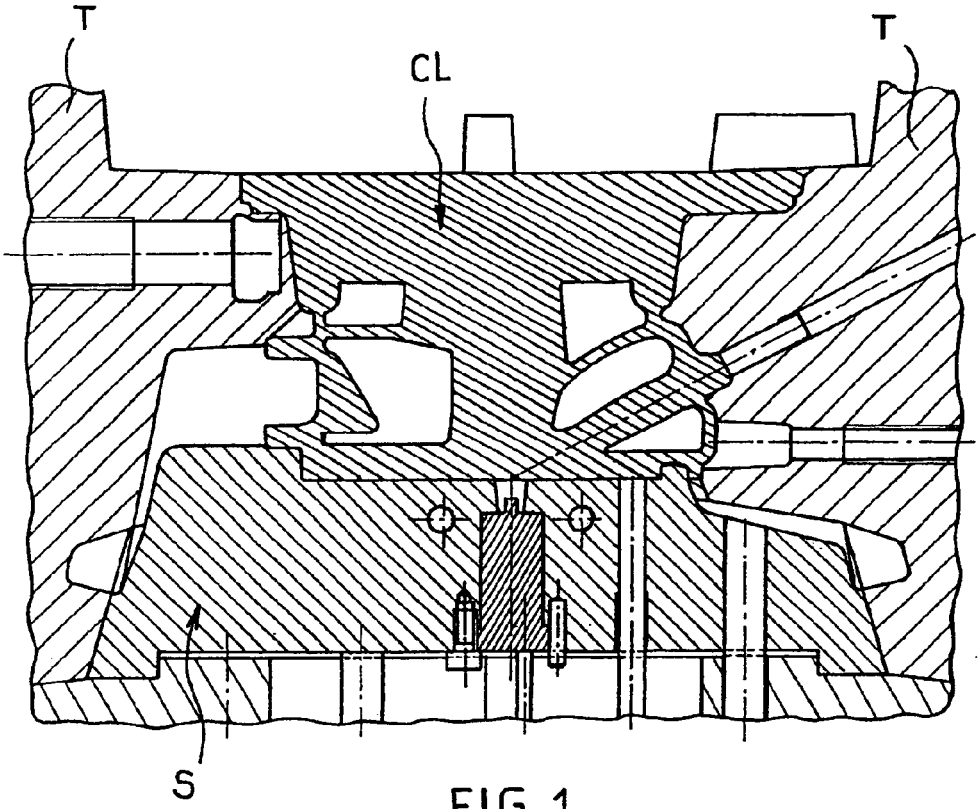
FIG. 1 is a longitudinal section through equipment for molding a cylinder head.
Figure 2:
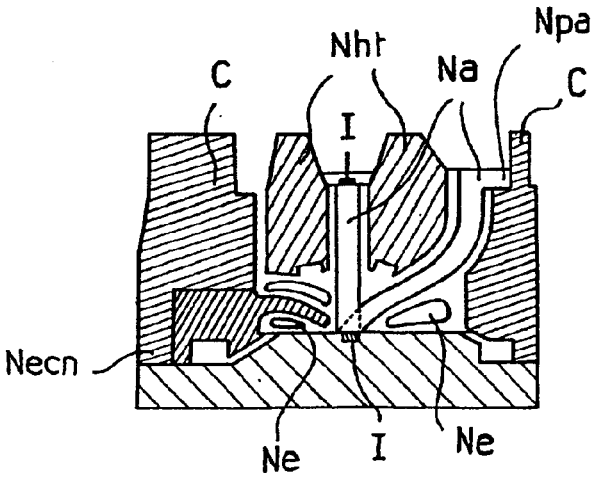
FIG. 2 is a diagrammatic cross-section view through the same equipment.

With reference initially to FIGS. 1 and 2, there is shown the conventional preparation of a cylinder head CL by gravity casting in a mold that is essentially constituted by a cooled metal soleplate S, cheeks C, and end slides T, the slides closing the mold perpendicularly to the cheeks C.

The inside shapes comprise cavities formed by admission pipe cores Na, exhaust pipe cores Nech, water circulation cores Ne, oil circulation cores, and top cores Nht (see in particular FIG. 2), the top cores also providing feeders for feeding liquid metal to the casting as it solidifies. The mold is fed with liquid metal from below using the gravity casting technique which is conventional for this type of part, via a delivery system SA (FIG. 1).

The cylinder head shown is for a diesel engine having four cylinders, sixteen valves, and direct injection. For this type of cylinder head, the performance of the engine depends strongly on the precision with which the admission pipes are positioned which in turn is determined by the precision with which the corresponding cores are positioned.

The overall assembly comprising the mold, the casting, and the casting appendices is shown diagrammatically in FIG. 1.

Figure 3:
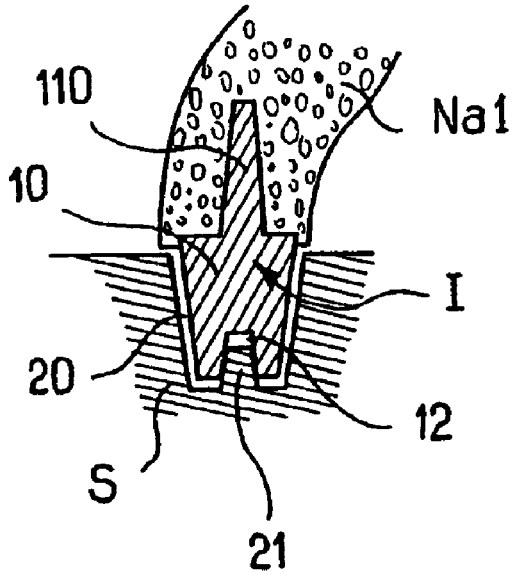
FIG. 3 is a cross-section view on a larger scale showing a detail of the equipment of the invention.
Figure 4:
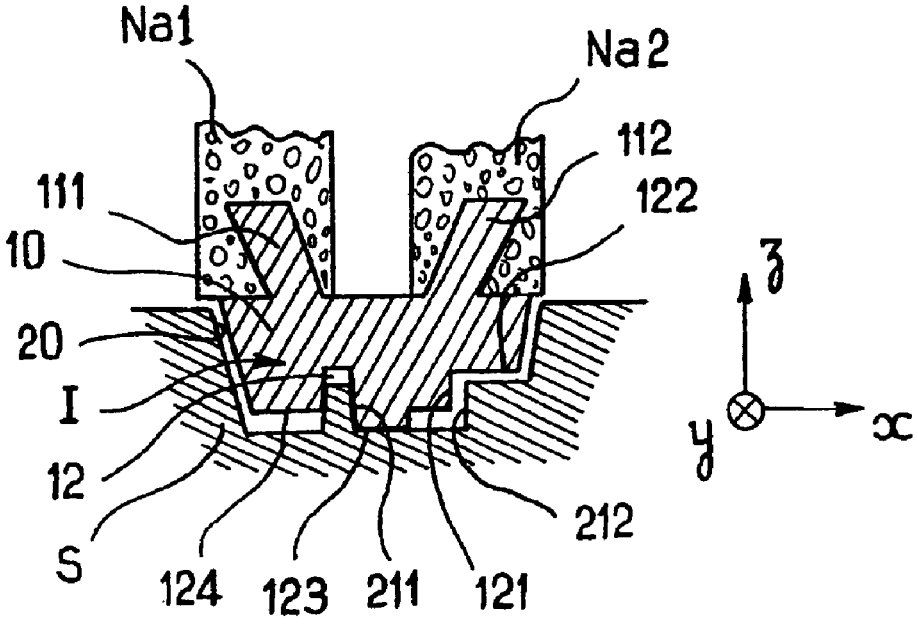
FIG. 4 is a longitudinal section view of the FIG. 3 detail.

In the invention, each pair of admission pipes is provided with end metal inserts I, as shown diagrammatically in FIG. 2 and in greater detail in the larger-scale views of FIGS. 3 and 4. FIG. 4 is a longitudinal section showing that the insert I of FIG. 3 in fact connects with two admission pipes, and in association with FIG. 3 shows how the insert provides guidance and support.

The essential purpose of having the insert I is to ensure that the metal mold element no longer makes contact with the core directly, but indirectly via the insert which is in turn secured to the core, and where appropriate via one or more other inserts, in particular another insert at the opposite end of the core. In this respect, it should be observed that the number and arrangement of the inserts depend essentially on the configuration of the core and of the precision required for positioning it.

Each insert I advantageously presents the following characteristics:

it is secured to the core(s) concerned (in this case two cores Na1 and Na2 for admission pipes) by being positioned in the core box while making the core(s);

it presents a main body 10 having projecting therefrom towards the core one or more sealing appendices, in this case two appendices 111 and 112 respectively for each of the two admission pipe cores Na1 and Na2, these appendices being embedded in the mass of sand and organic binder while the cores are being formed, such that once the binder has hardened, each core surrounds its appendices and an intimate bond is established between the core and the insert;

the body 10 of the insert has shapes adapted to guiding and positioning itself and thus the core, relative to generally complementary shapes provided in or on the facing metal mold element (in this case the soleplate S), as described in detail below;

the insert is designed in such a manner as to provide the contact surface between the core with which it is secured and the facing metal mold element so that the scale due to the core being degraded while hot does not disturb the manner in which the core fitted with its insert(s) is positioned relative to the metal element;

the shape of the insert I is selected so as to make it easy to produce, for example by casting a metal, in particular aluminum under pressure, selecting a material that is compatible with the alloy of the casting to be made, and in particular which does not give rise to any problems of compatibility on remelting; and in addition and regardless of the method used for making the insert(s), it is preferable to define all of the guidance and support shapes and surfaces on a single piece of tooling (typically a single mold element) used for making the inserts. This makes it possible to avoid undesirable mutual offsets between these shapes and surfaces as might otherwise happen, in particular if some of them are obtained from slides whose positioning during molding is not always guaranteed with good precision.

There follows a description in detail by way of example of possible guidance and support for inserts in three dimensions as shown in FIG. 4 where x designates the longitudinal direction of the cylinder head, y designates its transverse direction, and z the vertical direction.

In a basic embodiment, each insert is suitable for defining accurate positioning of the associated core by co-operating with the metal mold element via surfaces that provide support along each of the three axes x, y, and z.

Thus, in the present example, the body 10 of the insert is received in a generally complementary cavity 20 formed in the soleplate S, and presents on its bottom face a cavity 12 of generally rectangular shape which receives a protuberance 211 of generally complementary shape (ignoring clearances which are as small as possible) projecting from the bottom of the cavity 20. This ensures that the insert (and therefore also the core) is positioned relative to the axes x and y. In addition, in the vicinity of its cavity 12, the insert presents a support surface 123 suitable for coming into contact with the bottom surface of the cavity 20 in the soleplate, so as to position the insert and the core along the z axis.

FIG. 4 in particular shows other arrangements, namely 121, 122, and 124 on the insert and 212 on the soleplate which can also be used for properly positioning the insert.

It can also be seen that in order to facilitate engagement of the body 10 of the insert I in the cavity 20, it is advantageous to provide a relatively large taper or "draft" angle on the side faces of the insert and of the cavity.

Advantageously, these same insert arrangements (in this case the cavity 12 and the surface 123) are also used for positioning the insert in the core box when forming the core. This optimizes the resulting dimensional precision relating to the positioning of the core in the mold while making use of a single set only of positioning surfaces.

In some cases, and in particular for a cylinder head having a plurality of cylinders, there is no need to guide the admission cores in each chamber along three axes since these cores are also secured to one another by a common core portion Npa, as shown in FIG. 1.

In this type of configuration, and in the particular example of a five-cylinder engine, it is possible to provide for the inserts ordered 1 to 5 (one per cylinder) so that they co-operate with cavities formed in the soleplate S having the following guidance and support:

insert 1: y and z;

insert 2: z;

insert 3: x, y and z;

insert 4: z;

insert 5: y and z.

In addition, the top core now bears directly in the z-axis direction on half of the admission pipes (see FIG. 2), thereby guaranteeing that the inserts are pressed in the z direction and as a result ensuring that all of the admission pipe cores Na are pressed in the z direction. It should also be observed hat, if necessary, it is possible to provide inserts at the top ends of the cores Na.

Each insert I is made by casting under pressure. In order to make each set of admission pipe cores Na, five inserts are placed in the core box prior to forming the core. The core-making method described below is the "cold" box method, and it is characterized in particular by a resin content of 1% and silica sand having a grain size of 55 AFS.

The cylinder heads are cast under gravity with a standard alloy of the AS7U3G type having the following composition:

| | |
|---|---|
| Si: | 6.0 to 8.5 |
| Fe: | ≦0.50 |
| Cu: | 2.8 to 3.8 |
| Mg: | 0.05 to 0.50 |
| Zn: | ≦0.30 |
| Mn: | ≦0.30 |
| Ti: | ≦0.25 |
| others: | |
| individually: | ≦0.05 |
| together: | ≦0.15 |

(values in % by weight).

The casting temperature (as measured in the holding furnace) is 740° C. The soleplate S is cooled with water. Casting rate is 7 to 8 castings per hour.

Relative to the machining starts situated on the soleplate and belonging to the raw casting, guidance implemented in accordance with the invention by means of insert(s) makes it possible on a day's production of thirty consecutive cast cylinder heads to obtain positioning for the ends of the admission ducts (as measured on the castings after they have cooled down, been desanded, and after the metal feeder systems and the inserts have been removed) that is characterized by standard deviation that is less than or equal to 0.1 millimeter (mm) in all three dimensions x, y, and z.

Furthermore, it can be seen visually that the guidance shapes of the insert remain very clean, and in particular free from scale, which ensures that guidance is reproducible over time.

COMPARATIVE EXAMPLE

The same cylinder head mounted on the same principles and using the same alloy, but with the admission pipe cores being guided directly on the metal soleplate makes it possible to obtain positioning precision in the x, y, and z directions no better than the range 0.20 mm to 0.25 mm. Because of the regular maintenance required by the mold being used for manufacture, molding throughput is about 5% to 10% below the example of the invention.

Naturally, the present invention is not limited in any way to the embodiment described in particular above, and the person skilled in the art will be able to make numerous variants and modifications thereto.

What is claimed is:

1. A method for making a casting having at least one cavity defined by the positioning of a core, such as an aluminum alloy cylinder head for an engine, the method comprising the following steps:

making a metal insert having at least one support surface suitable for co-operating with corresponding bearing arrangements on a mold element, and at least one element for anchoring to the core;

making the core in a core box in which the insert has previously been placed in a predetermined position so that an end region of the core becomes anchored to said insert via the anchoring element(s) thereof; and placing the core with its insert in the mold in a position that is predetermined only by co-operation between the support surface(s) of the insert and the bearing arrangements of said mold element, and wherein said insert minimizes deposition of scale from the core material onto said bearing arrangements of said mold element so that the accuracy of the core position is improved.

2. A method according to claim 1, wherein the predetermined position of the insert in the core box is determined by co-operation between the support surface(s) of said insert and a support portion of the core box.

3. A method according to claim 1 or claim 2, wherein the step of making the core comprises making at least two cores which are anchored to a common insert.

4. A method according to claim 1 or claim 2, wherein the insert is made by molding metal under pressure.

5. A method according to claim 1 or claim 2, wherein the core is an admission pipe core.

6. A method according to claim 1 or claim 2, wherein the core is made by a cold box method.

* * * * *